United States Patent [19]

Shelly, Jr.

[11] 4,232,828

[45] Nov. 11, 1980

[54] HAND HELD LIQUID SPRAY HEAD WITH REMOVABLE LIQUID CONDUIT

[76] Inventor: Newton L. Shelly, Jr., 3105 Joslyn, Memphis, Tenn. 38128

[21] Appl. No.: 855,351

[22] Filed: Nov. 28, 1977

[51] Int. Cl.[3] ..... B05B 11/00

[52] U.S. Cl. ..... 239/329; 239/546; 222/214

[58] Field of Search ..... 222/214, 207, 382; 239/546, DIG. 12, 602; 417/474, 476, 477; 192/46

[56] References Cited

U.S. PATENT DOCUMENTS

| | | | |
|---|---|---|---|
| 70,371 | 10/1867 | Smith | 192/46 |
| 314,851 | 3/1885 | Kelly | 417/477 |
| 2,668,637 | 2/1954 | Gilmore | 222/214 |
| 2,963,228 | 12/1960 | Hait | 239/602 X |
| 3,386,630 | 6/1968 | Haviland | 222/383 X |
| 3,596,808 | 8/1971 | Corsette | 222/321 |
| 3,995,774 | 12/1976 | Cooprider et al. | 222/383 |
| 4,088,248 | 5/1978 | Blake | 222/207 |

FOREIGN PATENT DOCUMENTS

| | | | |
|---|---|---|---|
| 82606 | 8/1895 | Fed. Rep. of Germany | 239/602 |
| 1032414 | 3/1953 | France | 239/602 |

*Primary Examiner*—Robert J. Spar
*Assistant Examiner*—Frederick R. Handren
*Attorney, Agent, or Firm*—Lockwood, Dewey, Alex & Cummings

[57] ABSTRACT

A manually-actuated spray head for a liquid container includes a housing within which an insert is provided to establish a liquid flow path through the housing. One end of the insert is compressed by the housing to form a nozzle through which liquid is dispensed from the spray head. The other end of the insert is provided with a flange for sealing engagement with the container. A rotor rotatably driven by a user-actuated trigger compresses the center portion of the insert to force liquids through the nozzle under pressure. Since the entire liquid flow path of the spray head is defined by a replaceable insert construction of the housing is simplified and contamination of subsequently sprayed liquids can be avoided by changing the insert.

17 Claims, 8 Drawing Figures

HAND HELD LIQUID SPRAY HEAD WITH REMOVABLE LIQUID CONDUIT

BACKGROUND OF THE INVENTION

The present invention is directed generally to liquid spray heads, and more particularly to a liquid spray head wherein the liquid flow path is provided by a replaceable insert to simplify construction and to enable different types of liquids to be sprayed without contamination.

Many applications exist wherein the need exists for an economical and efficient manually-actuated spray head capable of spraying a number of different liquids. One such application is in the home, wherein a variety of liquids such as paint, paint removers, and stains may be required to complete a single project, and the cost of individual spray heads for each of these liquids would be prohibitive. Heretofore, where a single spray head has been used in such applications it has been necessary that the head be thoroughly cleaned after each use. This not only was a time-consuming operation, but also introduced the possibility of contamination by previously sprayed liquids with each use.

The paint sprayer of the present invention overcomes these deficiencies by incorporating a removable insert, which not only simplifies construction by eliminating the need for liquid seals, but also provides an independent flow path through the pump for each liquid.

As a result of the simplified housing construction the spray head can be economically manufactured from plastic or similar moldable material by conventional injection-molding techniques.

Accordingly, it is a general object of the present invention to provide a new and improved manually-actuated liquid spray head.

It is another object of the present invention to provide a new and improved liquid spray head wherein the flow path of liquid through the head is provided by an insert member.

It is another object of the present invention to provide a new and improved liquid spray head which can be economically manufactured by conventional injection-molding techniques.

SUMMARY OF THE INVENTION

The invention is directed to a liquid spray head which comprises a housing defining an interior pump chamber including an inlet portion for establishing liquid communication with a container of liquid to be sprayed, and an outlet portion for dispensing the liquid. Flow defining insert means are disposed within the chamber and include an inlet portion, and outlet portion, and a compressible center portion for establishing liquid communication between the inlet and outlet portions of the housing. A rotor is mounted for rotation within the housing and disposed to bear against the center portion of the insert to progressively occlude the center portion between the inlet and outlet portions of the insert whereby liquid therein is forced from the inlet portion to the outlet portion. User-actuable trigger means are provided for rotating the rotor, and nozzle forming means are provided within the outlet portion of the housing for compressing the outlet portion of the insert to form a nozzle for dispersing the liquid as it is pumped therethrough.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
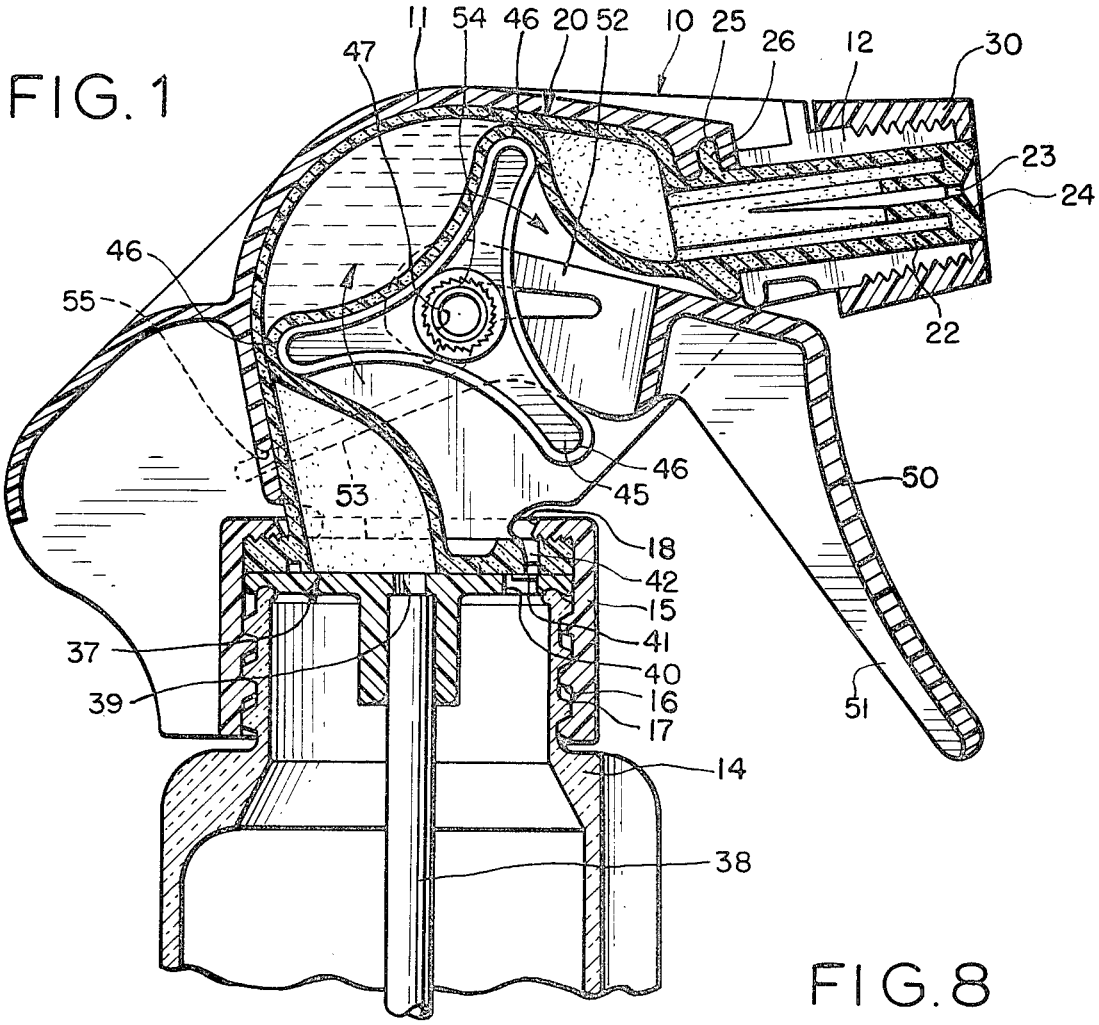
FIG. 1 is a side elevational view partially in cross section of a manually actuated spray head constructed in accordance with the invention showing the actuator handle thereof in an extended position.
Figure 2:
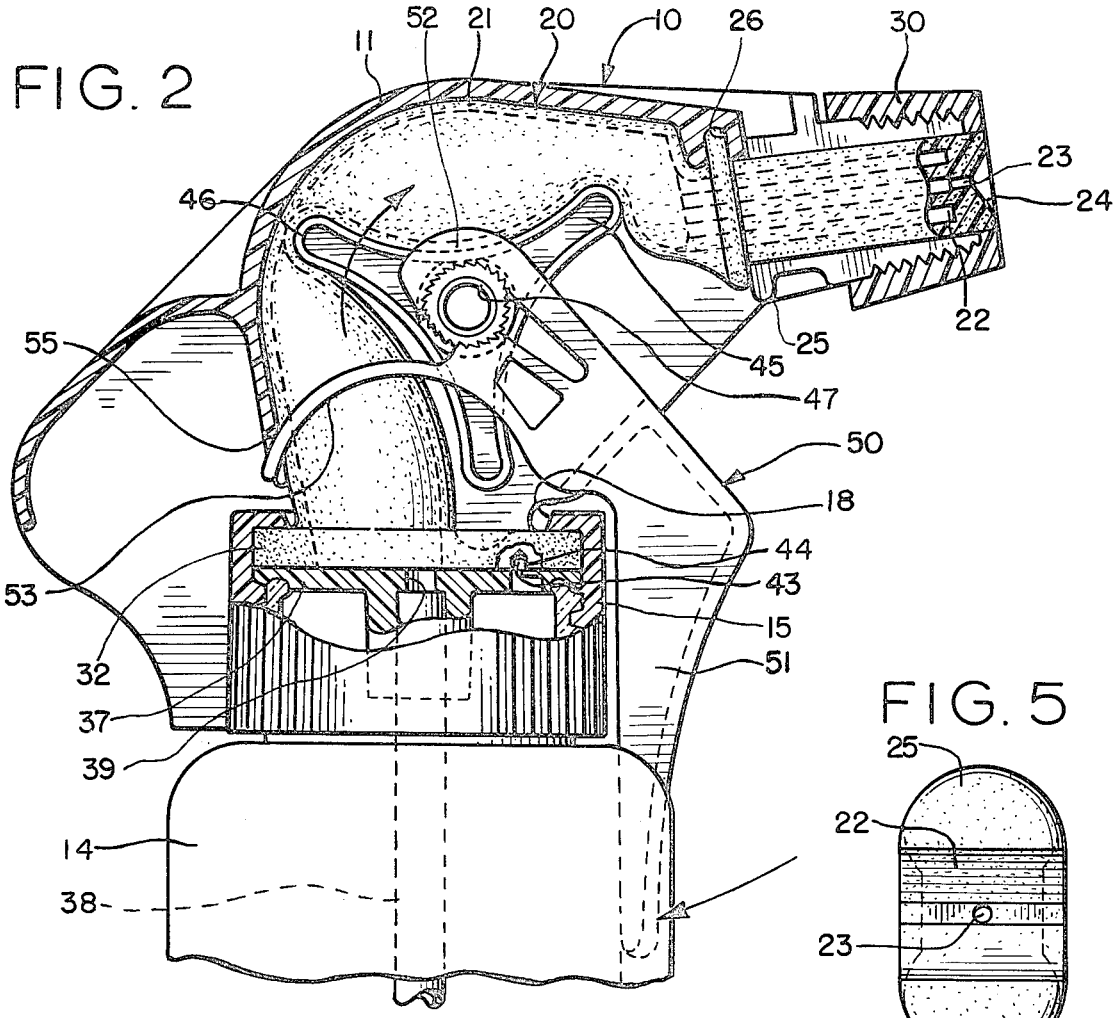
FIG. 2 is a side elevational view of the spray head partially in cross section illustrating the actuator handle in an actuated position.
Figure 3:
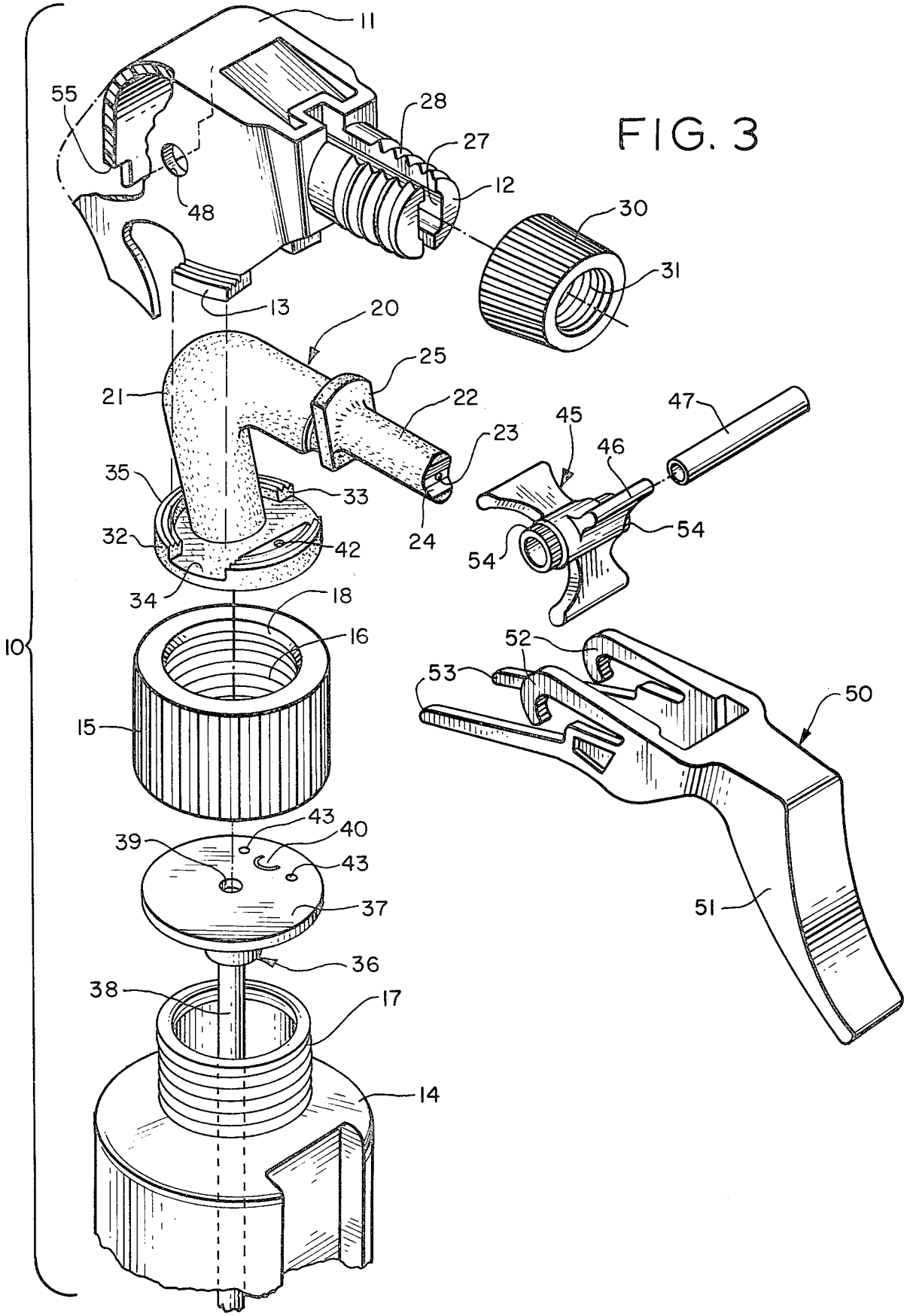
FIG. 3 is an exploded perspective view of the spray head showing the principal elements thereof.

Referring to the Figures, and particularly to FIGS. 1–3, a manually-actuated spray head 10 constructed in accordance with the invention comprises a molded housing 11 having an outlet or nozzle portion 12 (FIG. 3) at one end and an inlet or cap portion including two opposed outwardly-projecting tabs 13 (FIG. 3) at its other end. The nozzle and cap portions are arranged generally at right angles to each other whereby liquid discharged through the nozzle is directed at right angles to the mouth of a container on which the spray head is installed, as is general practice for manually-actuated sprayers.

The spray head is shown seated over the mouth of a container 14, which may be of conventional glass or plastic construction. Housing 11 is removably secured to the mouth of the container by means of an internally threaded cap 15 which includes an inside portion 16 threaded to engage a complimentarily threaded portion 17 on the rim of the container. The cap 15 includes an aperture 18 on its top surface through which the tabs 13 of housing 11 extend. In practice, when installing cap 15 on housing 11 the sides of the housing are inwardly deformed by the user to enable tabs 13 to fit through aperture 18, and are then released to allow the tabs to snap into position under the rim of the cap. In this way, the cap is attached to the housing so as to allow free rotation of the cap when attaching and detaching the spray head from the container.

In accordance with one aspect of the invention, liquids are conveyed through spray head 10 by means of a replaceable flow path-defining insert 20 formed of a deformable plastic such as polyvinylchloride (PVC) or a resilient rubber, or like material which does not chemically react with the liquid being sprayed. Insert 20 includes a central compressible body portion 21 formed in a generally L-shaped configuration to correspond to the interior of housing 11. At one end of the body portion the insert includes an outlet portion 22 consisting of a generally cylindrical projection having an aperture 23 centrally located on an inwardly-concave end wall 24 thereof. To provide for positive indexing of the nozzle portion within housing 11 a collar-shaped index portion 25 is provided between the body and outlet portions. This index portion is arranged generally perpendicularly to the axis of the nozzle projection, and is dimensioned to be slidably received within an indexing slot 26 (FIGS. 1 and 2) provided in housing 11.

To provide for receiving insert 20 the nozzle portion 12 of housing 11 is preferably bifurcated and provided with an elongated recess 27 therein. The external surface 28 of the nozzle portion is threaded to receive a nozzle cap 30 having a threaded inside surface 31. As a result, the compression force applied to outlet portion 22 by nozzle portion 12 can be varied over a wide and continuous range to allow the operator to select a wide and continuous range of spray patterns.

At the other end of insert 20 a flange portion 32 having a diameter slightly greater than the diameter of aperture 18 is provided to obtain a sealing engagement with container 14 when cap 15 is tightened. A raised rim 33 including appropriately positioned notches 34 for accommodating the mounting ears 13 of housing 11 extends around the flange to provide the sealing engagement with the inside rim of cap 15. To enhance the sealing engagement, the rim and mounting ears may each include a plurality of ribs 35 which compress against the inside rim of cap 15 when the latter is tightened about the neck of container 14.

When the pump head 10 is installed on container 14 fluid communication is established between insert 20 and the liquid contents of the container by means of a stem 36 fitted between the container rim and cap 15. This member includes a disk-shaped flange portion 37 adapted to seat between flange portion 32 and the rim of container 14. A flexible tubing segment 38 extends into container 14 from the bottom of the flange portion and communicates through an aperture 39 with the flow path within insert 20.

Figure 8:
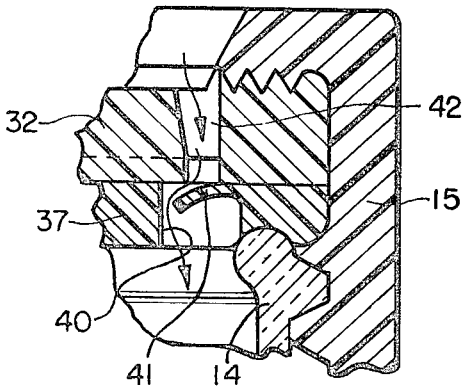
FIG. 8 is an enlarged cross-sectional view of a portion of the spray head showing the provision of a check valve therein for admitting air to an associated container as liquid is pumped therefrom.

To allow air to enter container 14 as liquid is pumped out by the spray head flange portion 37 is preferably provided with check-valve means in the form of an aperture 40 having a resilient flap 41 extending across the outer end thereof. When flap 41 is inwardly deformed, as shown in FIG. 8, communication is provided with the exterior of the container through an additional aperture 42 provided in the flange portion 32 of insert 20. A pair of locating pins 43 on the outside surface of flange 37 engage complimentarily dimensioned recesses 44 (FIG. 2) to assure that recesses 40 and 42 will be aligned as shown when the head assembly is assembled on the container. Alternatively, an annular groove can be provided on the bottom surface of flange portion 32 in communication with aperture 42 to obviate the need for alignment of the recesses.

To cause liquid to flow under pressure from container 14 through the spray head nozzle peristaltic pumping means in the form of a rotor 45 are provided within the central portion of housing 11. This rotor includes three uniformly spaced working surfaces 46 which bear against the side walls of the central portion 21 of the insert to force liquid contained therein to move toward the spray head nozzle as the rotor is rotated in a clockwise direction (as viewed in FIGS. 1 and 2). To this end, the opposing wall of housing 11 includes a semi-arcuate inside surface against which the side wall of insert 20 is compressed by rotor 45. The working surfaces 46 of the rotor are preferably rounded and the thickness of the body portion 21 of the insert is preferably closely controlled for most efficient pumping action.

Rotor 45 is mounted for rotation within housing 11 by means of a shaft 47 which extends through the rotor and is journaled in apertures 48 (FIG. 3) in the side walls of the housing. The rotor is positioned within housing 11 such that the three working surfaces 46 bear against the center portion 21 of insert 20 with sufficient force to achieve an efficient peristaltic pumping action.

Figure 7:
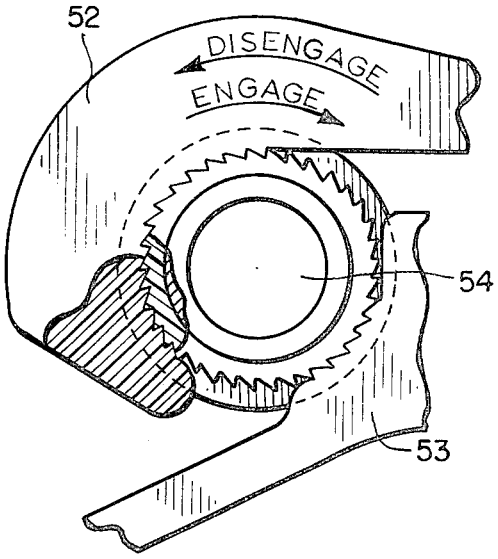
FIG. 7 is an enlarged side elevational view partially in cross section of the ratchet arrangement utilized to drive the rotor of the spray head.

To impart rotation to rotor 45 the spray head includes an actuator member 50 having user-actuable trigger portions 51 (FIG. 3) at one end, and pairs of parallel-spaced pawl and ratchet arms 52 and 53 at its other end. As best shown in FIGS. 2 and 7, the pawl arms 52 are each hook-shaped and have sawtooth-shaped serrations on their inside edge which engage complimentary serrations on respective ratchet wheels 54 on rotor 45. The pawl arms and ratchet wheels are held in contact by the ratchet arms 53 which each include a sawtooth-shaped surface which engages respective ones of the ratchet wheels 54 at locations diametrically opposed to the locations engaged by pawl arms 53. Ratchet arms 53 each include a resilient projecting portion which extends beyond the serrated pawl surface and into contact with housing 11. When actuator member 50 is mounted for coaxial rotation with rotor 45 in housing 11 these projecting portions bear against the housing at recess 55 so as to bias the actuator member in a counterclockwise position (as viewed in the Figures), thereby providing a restoring force to the trigger.

Insert 20 is installed in housing 11 by removing nozzle cap 30 and inserting the nozzle and body portions of the insert through aperture 18 into the housing. The nozzle portion is then compressed and seated in recess 27, after which the body portion is seated within the housing so that the flange portion of the insert is positioned against the inside rim of cap 15. The conduit assembly 37 is next seated on the rim of container 14 and cap 15 is turned over the container's neck to secure the spray head to the container.

Rotor 45 is next positioned between the pawl arms 52 of actuator member 50 and the resulting subassembly is inserted into housing 11 and positioned with shaft 47 journaled in apertures 48. In this position the ratchet arms 53 bear against recesses 55 so that trigger 51 is biased to an extended position as shown in FIG. 1. Upon actuation of trigger 51 ratchet arm 53 bends as shown in FIG. 2, thereby providing a restoring force which tends to return the trigger to its extended position when released.

When trigger 51 is actuated the direction of the sawtooth-shaped serrations is such that ratchet wheels 54, and hence rotor 45, are caused to rotate in a clockwise direction. However, when the trigger is released and allowed to return to its non-actuated position, the serrations do not establish a rotary coupling between the actuator member and the ratchet wheels and the rotor does not turn. In this way, a ratchet action is achieved which causes rotation of the rotor in a clockwise direction only upon each actuation of the trigger. Housing 11 and trigger 50 when assembled form a pistol-shaped structure, the downwardly and rearwardly (as viewed in FIG. 2) exterior surface of housing 11 providing a convenient thumb rest when grasping trigger 50 and container 14.

Figure 5:
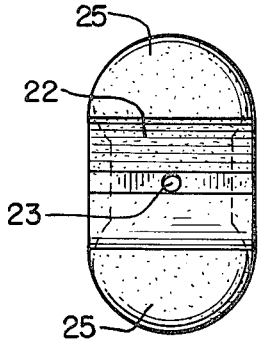
FIG. 5 is a front elevational view of the insert member taken along line 5—5 of FIG. 4.
Figure 4:
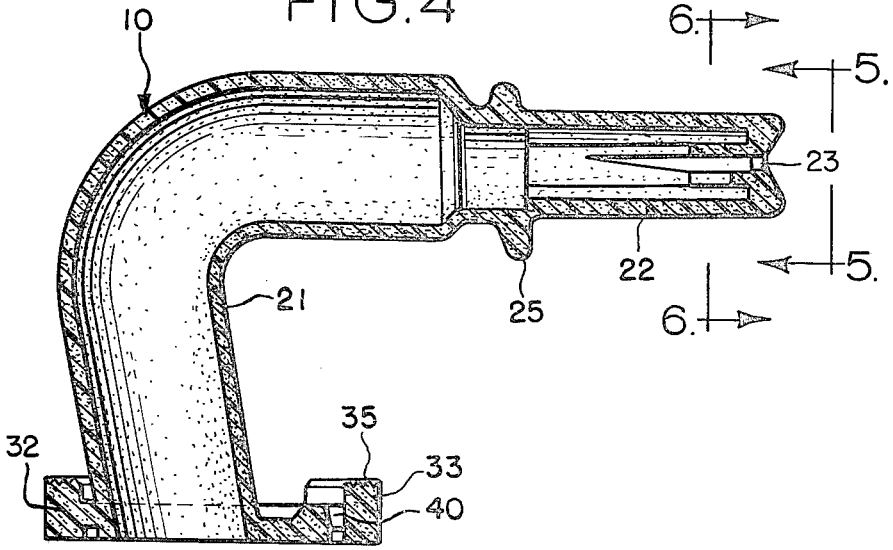
FIG. 4 is an enlarged cross-sectional view of the flow path defining the insert member utilized in the pump head.
Figure 6:
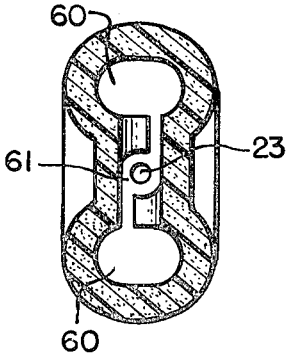
FIG. 6 is a cross-sectional view of the nozzle portion of the cartridge taken along line 6—6 of FIG. 4.

As rotor 45 rotates liquid contained within the pockets formed within cartridge 20 as a result of compression by the rotor is forced from the container to the nozzle. As shown in FIGS. 4–6, upon reaching the nozzle liquid flows through two parallel-spaced passageways 60 defined within the interior of the insert as a result of compression brought about on the insert by side walls of the nozzle portion of the housing. Internal ribbing within the nozzle portion of the insert defines a third passageway 61 parallel to passageways 60 into which fluid from passageways 60 flows under pressure. It is this central passageway which communicates with the spray aperture 23 and it is through this aperture that the liquid is discharged under pressure.

Since the entire assembly including pump chamber and nozzle are part of a replaceable insert, no danger of contamination between consecutively sprayed liquids exists. Furthermore, since the spray head is formed of components which can be easily manufactured by conventional molding techniques, and since the housing need not be liquid sealed, the spray head can be manufactured economically and is suitable for large volume production.

While a particular embodiment of the invention has been shown and described, it will be obvious to those skilled in the art that changes and modifications may be made therein without departing from the invention in its broader aspects, and therefore, the aim in the appended claims is to cover all such changes and modifications as fall within the true spirit and scope of the invention.

I claim:

1. A liquid spray head comprising, in combination:

a housing including an interior chamber, an inlet portion in communication with said chamber, an outlet portion in communication with said chamber, and an aperture extending between said chamber and the exterior of the housing;

flow defining insert means disposed within said chamber and insertable therein through said aperture, said insert means including an inlet portion extending into said inlet portion of said housing and providing liquid receiving means therein, an outlet portion extending into said outlet portion of said housing and providing liquid spray means therein, and a compressible center portion for establishing liquid communication between said inlet and outlet portions;

a rotor removably mounted for rotation within said chamber and including a plurality of working surfaces disposed to bear against said center portion of said insert means so as to progressively occlude said center portion between said inlet and outlet portions of said insert upon rotation of said rotor whereby liquid therein is forced from said inlet to said outlet portions thereof;

user-actuable trigger means pivotably mounted to said housing and extending through said aperture into operative engagement with said rotor for rotating said rotor to force fluid through the spray head, said rotor and trigger means being removable from said housing through said aperture to facilitate insertion and removal of said flow defining insert means.

2. A liquid spray head as defined in claim 1 wherein said trigger means and said rotor are operatively connected by ratchet means providing only one-way rotation of said rotor with each actuation of said trigger means.

3. A liquid spray head as defined in claim 2 wherein said ratchet means comprise a circumferential sawtooth surface on the rotor, and a pair of complementary sawtooth surfaces arranged on opposing jaw-shaped portions of said trigger means, said pair of surfaces being biased into operative engagement with said circumferential surface at opposite sides of said rotor.

4. A liquid spray head as defined in claim 3 wherein said jaw-shaped portions are resiliently outwardly deformable to facilitate disengagement of said trigger means from said rotor.

5. A liquid spray head as defined in claim 3 wherein said trigger means include a resilient projecting portion coacting with said housing to bias said trigger means to a non-actuated position.

6. A liquid spray head as defined in claim 1 wherein said outlet portion of said housing comprises a generally cylindrical extension of said housing including an axially-extending passageway, the sidewalls of said passageway being inwardly deformable, said outlet portion of said insert is received within said recess, and wherein said nozzle forming means comprise a cap threaded over said extension for forcing said sidewalls together to compress said outlet portion of said insert.

7. A liquid spray head as defined in claim 6 wherein said outlet portion of said insert includes at least one longitudinally extending internal rib portion defining an axial passageway within said outlet portion upon compression thereof.

8. A liquid spray head as defined in claim 1 wherein the spray head is adapted for installation on a container having a threaded neck, and said inlet portion of said housing includes an annular cap complementarily threaded for engaging the threaded neck of the container, and said inlet portion of said insert includes a flange portion adapted for sealing engagement between the rim of the container neck and the cap upon tightening of said cap on the container neck.

9. A liquid spray head comprising, in combination:

a housing defining an interior chamber, said housing including an inlet portion for establishing liquid communication with a container of liquid to be sprayed, and an outlet portion for dispensing the liquid;

flow defining insert means disposed within said chamber and including an inlet portion, an outlet portion, and a compressible center portion for establishing liquid communication between said inlet and outlet portions of the housing;

a rotor mounted for rotation within said housing and disposed to bear against said center portion of said insert to progressively occlude said center portion between said inlet and outlet portions of said insert whereby liquid therein is forced from said inlet portion to said outlet portion upon rotation of said rotor;

user-actuable trigger means pivotally mounted to said housing for rotating said rotor, said rotor being operatively connected to said trigger means by ratchet means allowing only one-way rotation of said rotor with said activation of said trigger means;

said ratchet means comprising a circumferential sawtooth surface on the rotor, and a pair of complementary sawtooth surfaces arranged on opposing jaw-shaped portions of said trigger means, said pair of surfaces being biased into operative engagement with said circumferential surface at opposite sides of said rotor.

10. A liquid spray head as defined in claim 9 wherein said jaw-shaped portions are resiliently outwardly deformable to facilitate disengagement of said trigger means from said rotor.

11. A liquid spray head as defined in claim 9 wherein said trigger means include a resilient projecting portion coacting with said housing to bias said trigger means to a non-activated position.

12. A liquid spray head for installation on a container having a threaded neck portion, comprising, in combination:

a housing defining an interior chamber, said housing including an inlet portion for establishing liquid communication with a container of liquid to be sprayed, and an outlet portion for dispensing the liquid;

flow defining insert means disposed within said chamber and including an inlet portion extending into said inlet portion of said housing, and an outlet portion extending into said outlet portion of said housing, and a compressible center portion for establishing liquid communication between said inlet and outlet portions;

a rotor mounted for rotation within said chamber and including a plurality of working surfaces disposed to bear against center portion of said insert means so as to progressively occlude said center portion between said inlet and outlet portions of said insert upon rotation of said rotor whereby liquid therein is forced from said inlet to said outlet portions thereof;

user-actuable trigger means pivotably mounted to said housing in operational engagement with said rotor for rotating said rotor to force fluid through said spray head;

said inlet portion of said housing including a rotatably mounted annular cap threaded for engagement with the neck portion of the container;

said inlet portion of said flow defining insert means including a first flange portion adapted for sealing engagement between the rim portion of the container and the cap upon tightening of the cap on the container neck, and an additional flange portion disposed between said first flange portion and said rim, and a stem portion extending from said additional flange portion into the container, said flange portions having means, including respective aligned apertures, forming a check valve for allowing air to enter the container only upon actuation of the spray head.

13. A liquid spray head as defined in claim 12 including indexing means for maintaining said apertures of said flange portions in alignment.

14. A liquid spray head comprising, in combination:

a housing defining an interior chamber, said housing including an inlet portion for establishing liquid communication with a container of liquid to be sprayed, and an outlet portion for dispensing the liquid;

flow defining insert means disposed within said chamber and including an inlet portion having an inlet aperture communicating with said container, an outlet portion having a spray release aperture, and a compressible center portion for establishing liquid communication between said inlet and outlet portions of said housing;

pump means within said housing arranged to compress said center portion of said insert to force liquid from said inlet portion to said outlet portion;

said outlet portion of said housing including a longitudinally extending recess having along at least a portion thereof an inwardly deformable sidewall;

said outlet portion of said insert means being received within said recess and being inwardly deformable therewith, and including at least one longitudinally extending internal rib portion forming an axially-extending passageway within said outlet portion upon inward deformation thereof; and user-actuable compression means for inwardly deforming said sidewall to form said axially-extending passageway.

15. A liquid spray head as defined in claim 14 wherein said outlet portion comprises a generally cylindrical inwardly-deformable externally-threaded housing portion, and said compression means comprises a cap member threaded over said externally-threaded portion.

16. A liquid spray head as defined in claim 14 wherein said outlet portion includes a pair of axially-extending rib portions disposed on opposite sides of the interior wall thereof to form a pair of parallel-spaced axially-extending passageways extending between said center position of said insert and said spray release nozzle.

17. A liquid spray head as defined in claim 16, wherein said rib portions further define a third passageway extending along the axis of said outlet portion between said spray release aperture and said parallel-spaced passageways.

* * * * *